United States Patent [19]

Coffindaffer

[11] Patent Number: 4,923,623

[45] Date of Patent: May 8, 1990

[54] STARCH WITH CURABLE AMINE FUNCTIONAL SILICONE FOR FABRIC WRINKLE REDUCTION AND SHAPE RETENTION

[75] Inventor: Timothy W. Coffindaffer, Loveland, Ohio

[73] Assignee: The Procter & Gamble Company, Cincinnati, Ohio

[21] Appl. No.: 287,782

[22] Filed: Dec. 21, 1988

[51] Int. Cl.[5] ..... D06M 00/90; C08G 37/26

[52] U.S. Cl. ..... 252/8.8; 252/8.9; 8/137

[58] Field of Search ..... 252/8.8, 8.9

[56] References Cited

U.S. PATENT DOCUMENTS

| | | | |
|---|---|---|---|
| 3,833,393 | 9/1974 | Kandathil | 106/212 |
| 4,246,423 | 1/1981 | Martin | 556/423 |
| 4,419,391 | 12/1984 | Tanaka et al. | 427/387 |
| 4,477,524 | 10/1984 | Brown et al. | 428/391 |
| 4,495,226 | 1/1985 | Smith | 427/326 |
| 4,665,116 | 5/1987 | Kornhaber et al. | 524/268 |
| 4,780,499 | 10/1988 | Villarreal et al. | 524/549 |
| 4,800,026 | 1/1989 | Coffindaffer | 252/8.8 |

FOREIGN PATENT DOCUMENTS 1102511 6/1981 Canada .

*Primary Examiner*—A. Lionel Clingman

*Attorney, Agent, or Firm*—Leonard Williamson; Robert B. Aylor; Richard C. Witte

[57] ABSTRACT

This invention relates to liquid starch containing compositions comprising curable amine functional silicones for wrinkle reduction and shape retention.

13 Claims, No Drawings

STARCH WITH CURABLE AMINE FUNCTIONAL SILICONE FOR FABRIC WRINKLE REDUCTION AND SHAPE RETENTION

FIELD OF THE INVENTION

This invention relates to starch compositions and to a method for treating fabrics for improved wrinkle reduction.

| U.S. Pat. No. | Date | Inventor(s) | U.S. Class/Sub. |
|---|---|---|---|
| | | U.S. Patent Documents | |
| 3,549,590 | 12/70 | Holdstock et al. | 260/46.5 |
| 3,576,779 | 4/71 | Holdstock et al. | 260/29.2 |
| 3,644,241 | 2/72 | Falivene | 524/50 |
| 3,833,393 | 9/74 | Kandathil | 106/212 |
| 4,246,423 | 1/81 | Martin | 556/423 |
| 4,419,391 | 2/83 | Tanaka et al. | 427/387 |
| 4,477,524 | 10/84 | Brown et al. | 428/391 |
| 4,507,219 | 3/85 | Hughes | 252/118 |
| 4,665,116 | 5/87 | Kornhaber et al. | 524/268 |
| 4,708,807 | 11/87 | Kemerer | 252/8.6 |
| SN 136,586 | 12/87 | Coffindaffer et al. now U.S. Pat. No. 4,800,026, issued Jan. 24, 1989. | |
| | | Other Documents | |
| EPA 0,058,493 | 8/82 | Ona et al. | |
| Can. 1,102,511 | 6/81 | Atkinson et al. | |

BACKGROUND OF THE INVENTION

In the modern world the vast majority of clothing is made from woven fabrics, and the art of weaving is many centuries old. Indeed the invention of weaving is generally attributed to the Ancient Egyptians. Yarns were produced from natural cotton, wool, or linen fibers, and garments made from fabrics woven from these yarns often creased badly in wear and, when washed or dry cleaned, required considerable time and effort with a steam pressing machine or iron to restore them to a pristine appearance.

With the increasing standard of living, there has been a general demand for a release from the labor involved in pressing cleaned clothes. At the same time the increased cost of labor has raised the expense of laundry and commercial dry cleaning considerably. This has resulted in additional pressure being brought to bear on textile technologists to produce fabrics and garments that can be simply cleaned and are ready to wear, and will keep a good appearance during wear.

Textile manufacturers have implemented two major improvements in wash-and-wear garments: (1) the use of cross-linking resins on cotton containing garments, and (2) the use of synthetics and synthetic blends. Although these two implementations have made major strides in reducing the wrinkling of a garment, consumers are still dissatisfied with the results and demand pressing after a cleaning operation.

Starch has been used for many years in fabric treatment to restore and retain them in a pristine appearance.

SUMMARY OF THE INVENTION

This invention relates to starch compositions comprising a curable amine functional silicone (CAFS)agent for fabric wrinkle reduction and fabric shape retention.

It is, therefore, an object of the present invention to provide some liquid starch compositions containing CAFS which provide superior wrinkle reduction and shape retention benefits to treated garments. This and other objects are obtained herein, and will be seen from the following disclosure.

DETAILED DESCRIPTION OF THE INVENTION

This invention relates to liquid starch compositions comprising curable amine functional silicone (CAFS) for improved fabric wrinkle reduction. In another respect this invention relates to methods of using such curable amine functional silicone compositions in the treatment of fabrics for improved wrinkle reduction and fabric shape retention. Preferred compositions are liquid which are sprayed onto or rinsed into the laundered fabrics. These preferred compositions are aqueous starch based liquids which contain from about 0.1% to about 33%, more preferably from about 0.5% to about 20% of the curable amine functional silicone. The more concentrated compositions can be diluted in a rinse. The lesser concentrated compositions are sprayed directly onto fabric.

The term "wrinkle reduction" as used herein means that a treated fabric is less likely to wrinkle or has less wrinkles after being worn or after a laundering operation than it would otherwise have after a comparable operation.

The term "shape retention" as used herein means that a pre-ironing CAFS/starch spray treated fabric is less likely to wrinkle or lose its ironed shape after being worn than it would otherwise after a comparable starch treatment.

In commonly assigned and copening U.S. Pat. Application Ser. No. 136,586, Coffindaffer and Wong, for a fabric softener composition, filed Dec. 22, 1987, now U.S. Pat. No. 4,800,026, issued Jan. 24, 1989, the present invention is disclosed, and incorporated herein by reference.

It is important to differentiate the curable amine functional silicones and the noncurable amine functional silicone. The curable amine functional silicone molecules have the ability to react one with the other to yield a polymeric elastomer of a much higher molecular weight compared to the original molecule. Thus, "curing" often occurs when two CAFS molecules or polymers react, yielding a polymer of a higher molecular weight. $[\sim SiOH + \sim SiOH \rightarrow \sim SiOSi \sim + H_2O]$. A more detailed version of the curing reaction is given below. This "cure" is defined herein as the formation of silicon-oxygen-silicon linkages. The silicon-oxygen-silicon linkage cure is distinguished from polysiloxane bridging reactions between amino groups and carboxyl (or epoxy) groups as disclosed in EPA 058,493, Ona et al., published Aug. 25, 1982, (Bulletin 82/34).

Curable amine functional silicones are commercially available; e.g., Dow Corning Silicone 531 and 536, General Electric SF 1706, SWS Silicones Corp. SWS E-210 are commercially available curable amine functional silicones widely marketed for use in hard surface care, such as in auto polishes, where detergent resistance and increased protection are very important.

Several fabric care compositions containing curable amine functional silicones are herein disclosed. Several methods of using curable amine functional silicones for wrinkle reduction fabric care are also disclosed.

The CAFS compositions of this invention are used with a suitable liquid carrier. The term "carrier" as used herein in general means any suitable vehicle that is used to deliver the CAFS and deposit it on the fabric. This invention comprises a liquid starch composition comprising the CAFS plus starch and a suitable carrier.

In a preferred execution, about 0.1% to about 10% by weight of an emulsified curable amine functional silicone is mixed into a suitable commercially available pump spray starch composition. The result is a spray starch composition that provides an improved wrinkle reduction benefit to fabric sprayed therewith. Suitable commercially available spray starch compositions are based on water and a suitable emulsifier. Care must be taken to use CAFS emulsifiers which are compatible with the starch and CAFS to avoid deemulsification. A second execution includes a laundry rinse wherein the level of CAFS is present in the rinse water at about 1–300 ppm, preferably about 5–150 ppm.

Preferably, care should be taken to insure that the compositions of the present invention are esentially free of heavy waxes, abrasives, fiberglass, and other fabric incompatibles.

CURABLE AMINE FUNCTIONAL SILICONE (CAFS)

Curable amine functional silicones can be prepared by known methods. U.S. Pat. Nos. 3,549,590, issued Dec. 22, 1970, and 3,576,779, issued Apr. 27, 1971, both to Holdstock et al., and assigned to General Electric Co., and incorporated herein by reference; U.S. Pat. Nos. 3,355,424, Brown, issued Nov. 28, 1967, and 3,844,992, Antonen, issued Oct. 29, 1974, both incorporated herein by reference, disclose methods of making curable amine functional silicones. Useful amino functional dialkylpolysiloxanes and methods for preparing them are described in U.S. Pat. Nos. 3,980,269, 3,960,575 and 4,247,330, whose pertinent disclosures are incorporated herein by reference. Curable amine functional silicones are disclosed in U.S. Pat. No. 4,419,391, Tanaka et al., issued Dec. 6, 1983, incorporated herein by reference.

The curable amine functional silicones of the present invention are preferably essentially free of silicone polyether copolymers disclosed in U.S. Pat. No. 4,246,423, Martin, issued Jan. 20, 1981.

The terms "amine functional silicone" and "aminoalkylsiloxane" are synonymous and are used interchangeably in the literature. The term "amine" as used herein means any suitable amine, and particularly cycloamine, polyamine and alkylamine, which include the curable alkylmonoamine, alkyldiamine and alkyltriamine functional silicones. The term "silicone" as used herein means a curable amine functional silicone, unless otherwise specified.

The preferred CAFS used in the present invention has an initial (before curing) average molecular weight of from at least about 1,000 up to about 100,000, preferably from about 1,000 to about 15,000, and more preferably from about 1,500 to about 5,000. While not being bound to any theory, it is theorized that the lower molecular weight CAFS compounds of this invention are best because they can penetrate more easily into the yarns of the fabric. The lower molecular weight CAFS is preferred, notwithstanding its expense and difficulty in preparation and/or stabilization.

The preferred CAFS of this invention when air dried cures to a higher molecular weight (MW) polymer. The CAFS of this invention can be either branched or straight chained, or mixtures thereof.

The preferred CAFS of this invention has the following formula:

$$((RO)R'_2SiO_{1/2})_X(R'_2SiO_{2/2})_Y(R''SiO_{3/2})_Z;$$

wherein

X is equal to Z+2 ;

Y is at least 3, preferably 10 to 35, and is equal to or greater than 3Z;

for a linear CAFS Z is zero;

for a branched CAFS Z is at least one;

R is a hydrogen or a $C_{1-20}$ alkyl; and

R′,R″ is a $C_{1-20}$ alkyl or an amine group;

wherein at least one of R′ or R″ is an amine group.

In the more preferred CAFS, R is a hydrogen or a $C_{1-3}$ alkyl; R′ is $C_{1-3}$ alkyl; and R″ is an alkylamine group having from about 2 to about 7 carbon atoms in its alkyl chain.

The value of Y and Z are dictated by the molecular weight of the CAFS. The value of Y is preferably 10 to 35 and the value of Z is preferably 1 to 3.

In the nomenclature "$SiO_{1/2}$" means the ratio of oxygen atoms to silicone atoms, i.e., $SiO_{1/2}$ means one oxygen atom is shared between two silicone atoms.

Preferred curable amine functional silicone agents are in the form of aqueous emulsions containing from about 10% to about 50% CAFS and from about 3% to about 15% of a suitable emulsifier.

General Electric Company's SF 1706 neat silicone (CAFS) fluid is a curable polymer that contains amine functional and dimethyl polysiloxane units.

Typical product data for SF 1706 silicone fluid is:

| Property | Value |
|---|---|
| CAFS content | 100% |
| Viscosity, cstks 25° C. | 15–40 |
| Specific gravity at 25° C. | 0.986 |
| Flash point, closed cup °C. | 66 |
| Amine equivalent (milli-equivalents of base/gm) | 0.5 |
| Diluents | Soluble in most aromatic and chlorinated hydrocarbons |

SF 1706 can be diluted to a concentration of from about 0.1% to about 80% and carried to fabrics via a suitable aqueous fluid.

A particularly preferred CAFS has the following formula:

$$((RO)R'_2SiO_{1/2})_X(R'_2SiO_{2/2})_Y(R''SiO_{3/2})_Z$$

wherein R is methyl; R′ is methyl; and R″ is $(CH_2)_3NH(CH_2)_2NH_2$; X is about 3.5; Y is about 27; and Z is about 1.5. The average molecular weight of such a curable amine functional silicone is about 2,500, but can range from about 1,800 to about 2,800. Other useful CAFS materials are disclosed in U.S. Pat. Nos. 4,665,116, Kornhaber et al., issued May 12, 1987 and 4,477,524, Brown et al., issued Oct. 16, 1984.

In use it is believed that the hydrolysis and curing of the CAFS are as follow:

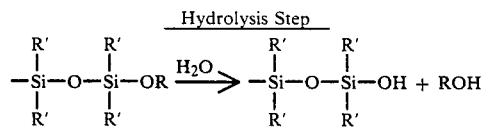

Curing Step

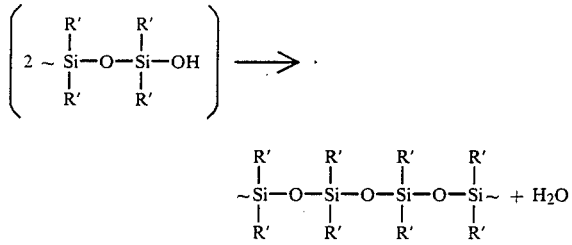

The fabric care composition of this invention comprises a suitable curable amine functional silicone and an aqueous carrier.

A specialty aqueous emulsion 124-7300 is made by General Electric Company. It contains 20% SF 1706 and about 5% of a mixture of octylphenoxypolyethoxyethanol and alkylphenylpoly(oxyethylene)glycol emulsifiers.

In preferred executions, the addition of from about 0.1% to about 33%, preferably from about 0.5% to about 20%, and, more preferably from about 1.0% to about 10% of the curable amine functional silicone by weight of the total aqueous starch composition can result in a product that provides outstanding wrinkle reduction benefits when fabric is rinse in or sprayed therewith in the usual manner. Another preferred execution is to spray an effective amount of an emulsified curable amine functional silicone on the freshly cleaned fabric or worn fabric.

STARCH

The present invention is a liquid starch composition comprising an effective amount of CAFS and up to about 99% liquid starch composition selected from conventional aqueous starch compositions. Such compositions contain from about 0.1% to about 35%, preferably from about 0.5% to about 20%, starch, a little surfactant, minors, and the balance water. Starch is employed to aid in ironing and sizing and to act as a carrier for the curable amine functional silicone component. Thus, any of the aqueous based starch compositions used in the fabric care art may be used herein. E.g., U.S. Pat. Nos. 4,780,499, Villarreal et al., issued Oct. 25, 1988; 3,644,241, Falivene, issued February, 1972; 3,833,393, Kandathil, issued September, 1974; and 4,495,226, Smith, issued Jan. 22, 1985; incorporated herein by reference in their entirety, disclose suitable starch and starch derivative compositions.

The amount of aqueous carrier included in the compositions of the present invention can vary depending upon the execution used and the type of composition to be formulated. Preferably, water or $C_1$–$C_4$ alcohols or mixtures thereof comprise from about 10% to about 98% by weight of the composition, and most preferably from about 60% to about 90% by weight of the starch/CAFS composition.

EXAMPLE I

About 25 grams of emulsified CAFS (25 parts) (20% CAFS emulsion of GE SF-1706) (5 parts CAFS) is added to 75 parts of a 2–3% starch composition ("Spray 'N Starch" made by Texize ®, a division of Dow, Inc.) with stirring at ambient temperature. This mixture containing about 5% CAFS is used as a pre-ironing spray-on for fabric wrinkle reduction and shape retention.

EXAMPLES II AND III

Two additional starch/CAFS compositions are prepared as in Example I. About 5 parts and 50 parts of the 20% CAFS emulsion are, respectively, mixed with the liquid Spray 'N Starch compositions to provide, respectively, stable 1% and 10% CAFS compositions.

The starch compositions are stable.

What is claimed is:

1. A liquid starch composition for treating laundered fabrics, said composition comprising: (1) from about 0.1% to about 33% by weight of a curable amine functional silicone emulsion for wrinkle reduction, and (2) from about 0.5% to about 35% of a laundry starch and (3) water to deposit said curable amine functional silicone and said starch on said fabric, wherein said curable amine functional silicone on said fabric cures to form silicone-oxyen-silicone linkages;

wherein said curable amine functional silicone is selected from the group of linear and branch curable amine functional branch silicones and mixtures thereof having the following structure:

$$((RO)R'_2SiO_{1/2})_X(R'_2SiO_{2/2})_Y(R''SiO_{3/2})_Z;$$

wherein

X is equal to Z+2; and

Y is at least 3; and wherein

Z is zero for a linear curable amine functional silicone;

Z is at least one for a branched curable amine functional silicone;

wherein

R is a hydrogen or a $C_{1-20}$ alkyl; and

R', R'' is a $C_{1-20}$ alkyl or an amine group selected from cyclic amines, polyamines and alkylamines having from about 2 to about 7 carbon atoms in their alkyl chain, and wherein at least R' or R'' is an amine group.

2. The composition of claim 1 wherein said composition contains a liquid selected from the group consisting of: surfactants, lower molecular weight $C_1$–$C_4$ alcohols, and mixtures thereof.

3. The composition of claim 1 wherein said composition contains from about 0.5% to about 25% of said curable amine functional silicone.

4. The composition of claim 3 said concentrate contains from about 1% to about 10% of said curable amine functional silicone.

5. The composition of claim 4 wherein said curable amine functional silicone has an average molecular weight of from about 1,000 to about 100,000.

6. The composition of claim 5 wherein said water is present at a level of from about 50% to about 98% by weight of the total composition.

7. The composition of claim 6 wherein said silicone has an average molecular weight of from about 1,000 to about 15,000.

8. The composition of claim 7 wherein said silicone has an average molecular weight of from about 1,500 to about 5,000.

9. The composition of claim 1 wherein

R is a hydrogen or a $C_{1-3}$ alkyl;

R' is $C_{1-3}$ alkyl; and

R'' is an alkylamine group having from about 2 to about 7 carbon atoms in its alkyl chain.

10. The composition of claim 9 wherein said R is methyl; R′ is methyl and R″ is $(CH_2)_3NH(CH_2)_2NH_2$; and X is about 3.5; Y is about 27 and Z is about 1.5; and wherein said curable amine functional silicone has a molecular weight in the range of from about 1,000 to about 2,800 and a viscosity of about 5–40 centistokes at 25° C.

11. A method of reducing wrinkles in laundered fabrics by applying to said fabrics the starch composition of claim 1.

12. The method of claim 11 wherein said curable amine functional silicone is present in said starch composition at a level of from about 0.5% to about 20% by weight.

13. The method of claim 11 wherein said curable amine functional silicone is present at a level of from about 1% to about 10% by weight.

* * * * *